US010858864B2

(12) United States Patent
Pfunder

(10) Patent No.: US 10,858,864 B2
(45) Date of Patent: Dec. 8, 2020

(54) MOTOR-DRIVEN LOCK WITH ROLLER

(71) Applicant: Schlage Lock Company LLC, Carmel, IN (US)

(72) Inventor: Dan Pfunder, Noblesville, IN (US)

(73) Assignee: Schlage Lock Company LLC, Carmel, IN (US)

( * ) Notice: Subject to any disclaimer, the term of this patent is extended or adjusted under 35 U.S.C. 154(b) by 160 days.

(21) Appl. No.: 16/185,617

(22) Filed: Nov. 9, 2018

(65) Prior Publication Data

US 2020/0149320 A1 May 14, 2020

(51) Int. Cl.

| | |
|---|---|
| ***E05B 47/06*** | (2006.01) |
| ***E05B 65/46*** | (2017.01) |
| ***E05B 67/22*** | (2006.01) |
| ***E05B 17/20*** | (2006.01) |
| ***E05B 47/00*** | (2006.01) |

(52) U.S. Cl.

CPC ..... *E05B 47/06* (2013.01); *E05B 17/2011* (2013.01); *E05B 47/0012* (2013.01); *E05B 47/0603* (2013.01); *E05B 47/0607* (2013.01); *E05B 65/46* (2013.01); *E05B 67/22* (2013.01); *E05B 2047/0057* (2013.01)

(58) Field of Classification Search

CPC ..... E05B 47/06; E05B 65/46; E05B 67/22; E05B 47/0603; E05B 47/0607; E05B 17/2011; E05B 47/0012; E05B 2047/0057; E05B 47/0696

USPC ..... 70/DIG. 3, 28, 38 A, 38 B, 38 C, 42–44, 70/85–88, 386, 277, 278.7, 279.1, 70/280–283; 292/9, 12, 15, 23, 73, 75, 292/77, 79, 193, 239, 252, 144, 341.15, 292/341.16

See application file for complete search history.

(56) References Cited

U.S. PATENT DOCUMENTS

| | | | | | |
|---|---|---|---|---|---|
| 2,139,193 | A * | 12/1938 | Lamothe | B60K 15/05 | 292/252 |
| 2,931,204 | A | 4/1960 | Check | | |
| 4,071,271 | A * | 1/1978 | Bourrie | E05B 47/0002 | 292/201 |
| 4,127,966 | A * | 12/1978 | Schmidt | E05B 47/0002 | 292/252 |
| 4,647,089 | A * | 3/1987 | Zangrando | E05B 51/02 | 292/144 |
| 4,677,834 | A * | 7/1987 | Hicks | E05B 47/0002 | 292/144 |

(Continued)

*Primary Examiner* — Lloyd A Gall

(74) *Attorney, Agent, or Firm* — Taft Stettinius & Hollister LLP

(57) ABSTRACT

An exemplary locking mechanism includes a plunger, a lock control member adjacent the plunger, a roller captured between the plunger and the lock control member, a driver operably connected with the lock control member, and a control assembly operable to control the driver to move the lock control member between a locking position and an unlocking position. The locking mechanism has a locking state in which the lock control member is in the locking position, and interference between the roller and the lock control member prevents movement of the plunger in a retracting direction. The locking mechanism has an unlocking state in which the plunger is in the unlocking position such that the roller is operable to move into a pocket formed in the lock control member, thereby enabling movement of the plunger in the retracting direction.

23 Claims, 5 Drawing Sheets

(56) References Cited

U.S. PATENT DOCUMENTS

| | | | | |
|---|---|---|---|---|
| 4,878,265 | A * | 11/1989 | Nesbitt | E05B 47/0002 16/49 |
| 5,746,458 | A | 5/1998 | Fisher | |
| 5,771,742 | A * | 6/1998 | Bokaie | B64G 1/22 337/140 |
| 6,412,320 | B1 * | 7/2002 | Maniago | E05B 47/0696 292/140 |
| 6,442,983 | B1 | 9/2002 | Thomas et al. | |
| 8,083,274 | B2 * | 12/2011 | Caldwell | B60R 21/34 292/252 |
| 8,453,481 | B2 | 6/2013 | Meekma | |
| 8,850,858 | B2 | 10/2014 | Nave | |
| 9,222,280 | B2 | 12/2015 | Mackle | |
| 9,528,297 | B2 | 12/2016 | Gentile | |
| 9,670,699 | B2 | 6/2017 | Sallinen et al. | |
| 2002/0046584 | A1 | 4/2002 | Lumpkin et al. | |
| 2008/0178640 | A1 | 7/2008 | Davis | |
| 2015/0292244 | A1 | 10/2015 | Beatty | |
| 2015/0330120 | A1 * | 11/2015 | Hogan | E05C 1/004 292/138 |
| 2017/0204637 | A1 | 7/2017 | Matyko | |
| 2017/0236349 | A1 * | 8/2017 | Marsh | E05B 65/0089 70/278.1 |
| 2017/0342742 | A1 | 11/2017 | Snodgrass | |
| 2017/0356219 | A1 * | 12/2017 | Roatis | E05B 47/0692 |
| 2018/0165901 | A1 | 6/2018 | Lai | |
| 2019/0344849 | A1 * | 11/2019 | Weiershausen | E05B 47/0012 |

* cited by examiner

MOTOR-DRIVEN LOCK WITH ROLLER

TECHNICAL FIELD

The present disclosure generally relates to locking assemblies, and more particularly but not exclusively relates to motor-driving locking assemblies.

BACKGROUND

Padlocks and cabinet locks are traditionally key-driven locking mechanisms in which rotation of the key is used to move a blocking feature from a blocking position to an unblocking position. This movement of the blocking feature permits the padlock shackle or the cabinet drawer to be moved from the closed position to the open position. While some electronic versions of padlocks and cabinet locks exist in the market, such existing devices typically have limitations, such as those relating to the mechanical strength thereof. These issues are compounded for battery-powered motor-driven locks, which typically do not have the robustness to meet the high static and dynamic load abuse conditions that must be withstood by high-security locking systems. For these reasons among others, there remains a need for further improvements in this technological field.

SUMMARY

An exemplary locking mechanism includes a plunger, a lock control member adjacent the plunger, a roller captured between the plunger and the lock control member, a driver operably connected with the lock control member, and a control assembly operable to control the driver to move the lock control member between a locking position and an unlocking position. The locking mechanism has a locking state in which the lock control member is in the locking position, and interference between the roller and the lock control member prevents movement of the plunger in a retracting direction. The locking mechanism has an unlocking state in which the plunger is in the unlocking position such that the roller is operable to move into a pocket formed in the lock control member, thereby enabling movement of the plunger in the retracting direction. Further embodiments, forms, features, and aspects of the present application shall become apparent from the description and figures provided herewith.

DETAILED DESCRIPTION OF ILLUSTRATIVE EMBODIMENTS

Figure 1:
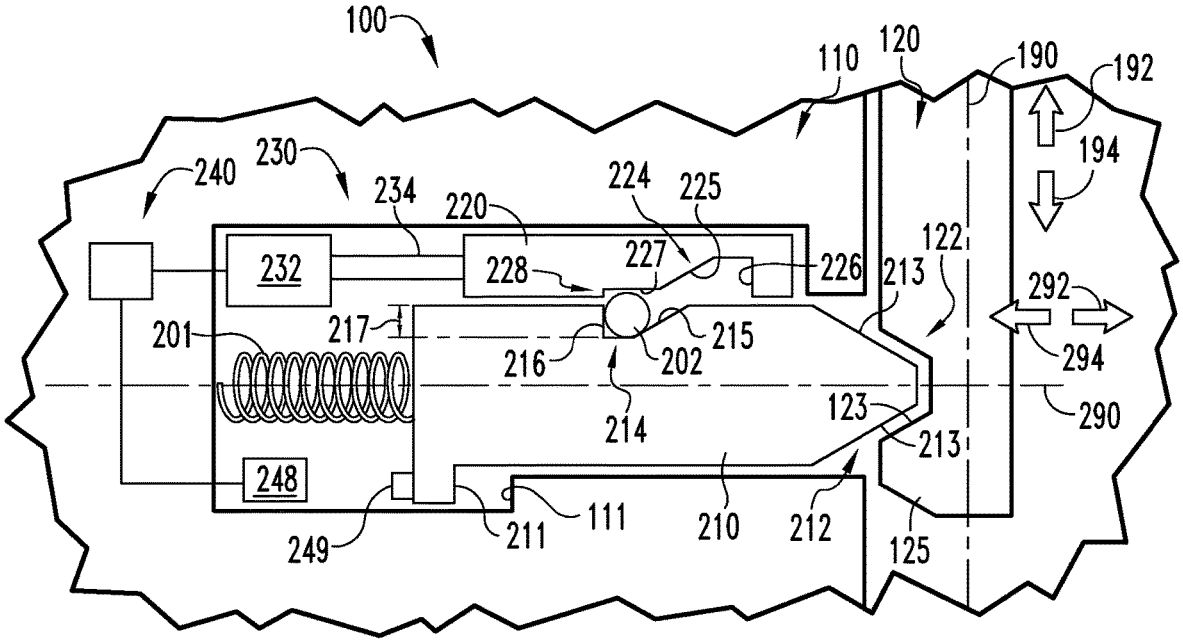
FIG. 1 is a schematic sectional view of a security assembly including a locking mechanism according to certain embodiments, wherein the locking mechanism is in a locked state and a plunger is in an extended position.

Although the concepts of the present disclosure are susceptible to various modifications and alternative forms, specific embodiments have been shown by way of example in the drawings and will be described herein in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. It should further be appreciated that although reference to a "preferred" component or feature may indicate the desirability of a particular component or feature with respect to an embodiment, the disclosure is not so limiting with respect to other embodiments, which may omit such a component or feature. Further, when a particular feature, structure, or characteristic is described in connection with an embodiment, it is submitted that it is within the knowledge of one skilled in the art to implement such feature, structure, or characteristic in connection with other embodiments whether or not explicitly described.

Additionally, it should be appreciated that items included in a list in the form of "at least one of A, B, and C" can mean (A); (B); (C); (A and B); (B and C); (A and C); or (A, B, and C). Similarly, items listed in the form of "at least one of A, B, or C" can mean (A); (B); (C); (A and B); (B and C); (A and C); or (A, B, and C). Further, with respect to the claims, the use of words and phrases such as "a," "an," "at least one," and/or "at least one portion" should not be interpreted so as to be limiting to only one such element unless specifically stated to the contrary, and the use of phrases such as "at least a portion" and/or "a portion" should be interpreted as encompassing both embodiments including only a portion of such element and embodiments including the entirety of such element unless specifically stated to the contrary.

In the drawings, some structural or method features may be shown in certain specific arrangements and/or orderings. However, it should be appreciated that such specific arrangements and/or orderings may not be required. Rather, in some embodiments, such features may be arranged in a different manner and/or order than shown in the illustrative figures unless indicated to the contrary. Additionally, the inclusion of a structural or method feature in a particular figure is not meant to imply that such feature is required in all embodiments and, in some embodiments, may not be included or may be combined with other features.

With reference to FIG. 1, illustrated therein is a security assembly 100 according to certain embodiments. The security assembly 100 generally includes a first member 110 and a second member 120 that is movable relative to the first member 110. Movement of the second member 120 relative to the first member 110 is limited or constrained to motion along a movement axis 190, and the second member 120 is operable to move along the movement axis 190 in each of an opening direction 192 (upward in FIG. 1) and a closing direction 194 (downward in FIG. 1). More particularly, the second member 120 is movable along the movement axis 190 between a fully-closed position (FIGS. 1 and 2), a partially-closed position (FIG. 3), and an open position (FIG. 4).

Figure 8:
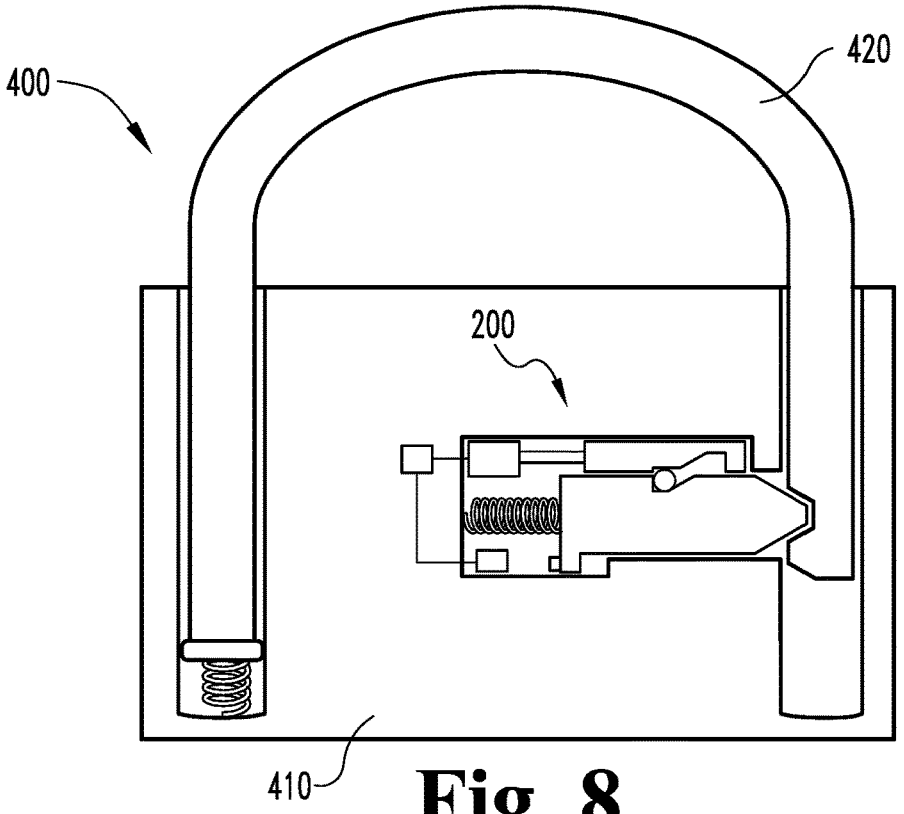
FIG. 8 is a schematic illustration of a padlock including the locking mechanism illustrated in FIG. 1.
Figure 9:
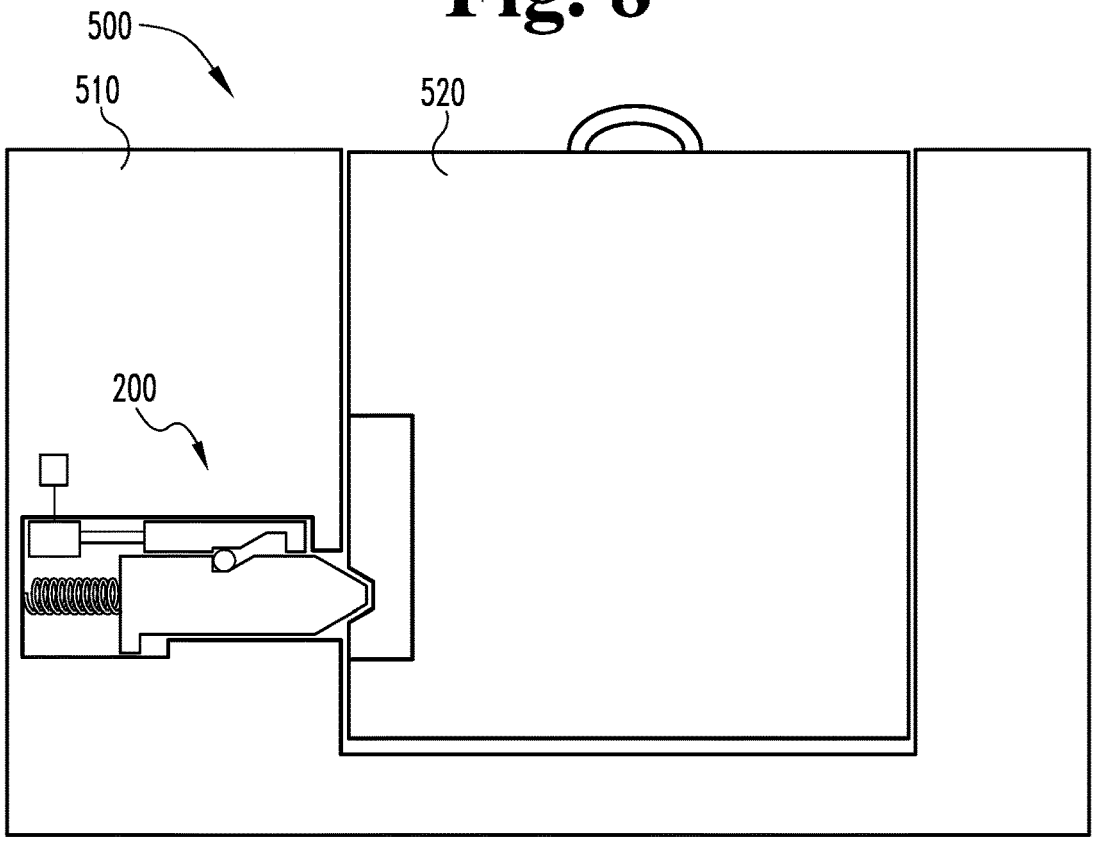
FIG. 9 is a schematic illustration of a cabinet including the locking mechanism illustrated in FIG. 1.

In certain embodiments, the security assembly 100 may be provided in the form of a padlock assembly in which the first member 110 is provided in the form of a body portion and the second member 120 is provided as a shackle that is movably mounted to the body portion. An example of such a padlock 400 is illustrated in FIG. 8. In other embodiments, the security assembly 100 may be provided in the form of a cabinet assembly in which the first member 110 is provided in the form of a housing and the second member 120 is mounted to a drawer that is slidably mounted to the housing. An example of such a cabinet 500 is illustrated in FIG. 9. While certain example embodiments of the security assembly 100 are specifically described and illustrated herein, it is to be appreciated that other forms are contemplated. As one example, the security assembly 100 may be provided in the form of a closure assembly in which the first member 110 is provided in the form of a doorframe and the second member 120 is provided as a sliding door that is slidably mounted within the doorframe.

The security assembly 100 further includes a locking mechanism 200 that selectively prevents movement of the second member 120 relative to the first member 110. The locking mechanism 200 is mounted to the first member 110, and generally includes a plunger 210 operable to engage the second member 120, a lock control member 220 positioned adjacent the plunger 210, a roller 202 captured between the plunger 210 and the lock control member 220, a driver 230 operably connected with the lock control member 220, and a control assembly 240 in communication with the driver 230. In certain embodiments, the roller 202 may be spherical, while in other embodiments the roller 202 may be cylindrical.

The plunger 210 is mounted in the first member 110 for movement along a longitudinal axis 290, which defines a proximal or extending direction 292 (to the right in FIG. 1) and a distal or retracting direction 294 (to the left in FIG. 1). The plunger 210 is biased in the extending direction 292 by a spring 201. The plunger 210 may include a protrusion 211 that interfaces with a shoulder 111 to limit movement of the plunger 210 in the extending direction 292. A proximal end of the plunger 210 defines a tapered nose 212 that is operable to engage a correspondingly-shaped recess 122 formed in the second member 120. When the second member 120 is in a closed position relative to the first member 110 and the plunger 210 is in an extended position (FIG. 1), the tapered nose 212 extends into the recess 122 such that the nose 212 is at least partially seated in the recess 122. The nose 212 includes a pair of cam surfaces 213, and the recess 122 includes a corresponding pair of cam surfaces 123.

FIG. 1 illustrates the security assembly 100 with the second member 120 in a closed position relative to the first member 110. In this state, the biasing force of the spring 201 urges the nose 212 into the recess 122. When a force is applied to urge the second member 120 in the opening direction 192 relative to the first member 110, the cam surfaces 123, 213 engage one another and urge the plunger 210 in the distal or retracting direction 294. As described herein, the locking mechanism 200 is operable to selectively prevent such movement of the plunger 210, and thereby selectively prevents movement of the second member 120 in the opening direction 192.

The plunger 210 also includes a pocket 214 facing the lock control member 220. The pocket 214 is sized and shaped to receive the roller 202, and is defined in part by a proximal ramp 215. A distal side of the pocket 214 may be defined at least in part by a shoulder 216. A depth 217 of the pocket 214 may correspond to the diameter of the roller 202. For example, the depth 217 of the pocket 214 may be slightly less than the roller diameter such that the roller 202 is operable to engage a ledge 228 on the lock control member 220.

Figure 2:
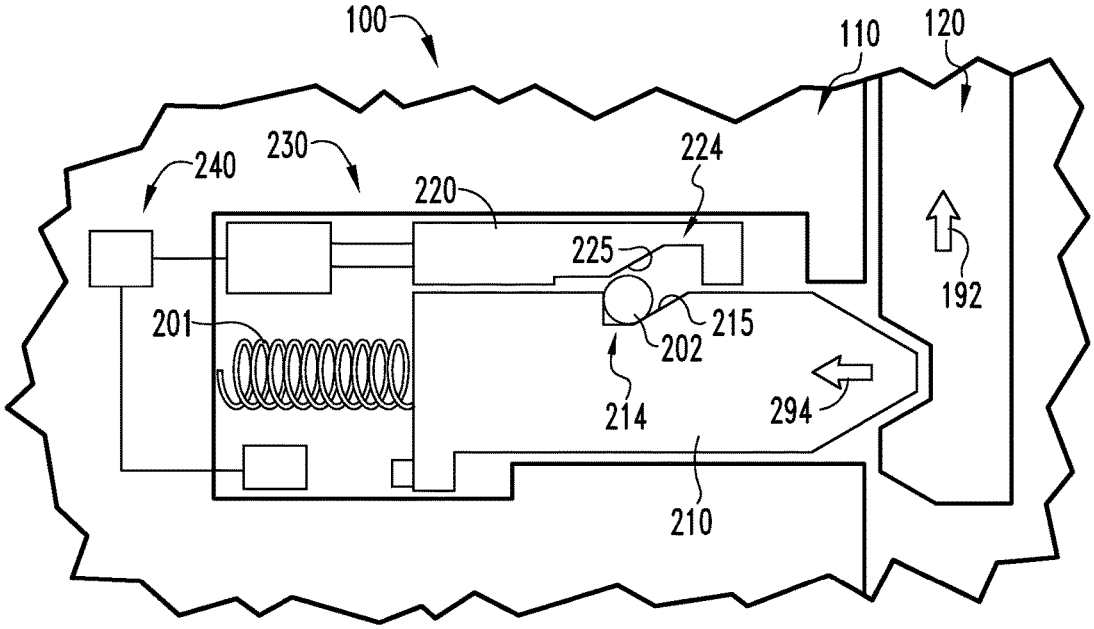
FIG. 2 is a schematic sectional view of the security assembly illustrated in FIG. 1 with the locking mechanism in an unlocked state and with the plunger in the extended position.

The lock control member 220 is mounted for movement in the proximal direction 292 and the distal direction 294 between a locking position (FIG. 1) and an unlocking position (FIG. 2). Like the plunger 210, the lock control member 220 includes a pocket 224 that is sized and shaped to receive at least a portion of the roller 202. The pocket 224 faces the plunger 210, and is defined in part by a distal ramp 225. A proximal side of the pocket 224 may be defined at least in part by a shoulder 226. The lock control member 220 further includes a blocking surface 227 formed distally of the pocket 224, and a ledge 228 is formed distally of the blocking surface 227 and is operable to engage the roller 202.

With the lock control member 220 in the locking position (FIG. 1), the roller 202 is received in the plunger pocket 214 and is aligned with the blocking surface 227. With the lock control member 220 in the locking position, the locking mechanism 200 is in a locked state in which distal or retracting movement of the plunger 210 is prevented. In this state, an attempt to move the second member 120 in the opening direction 192 urges the plunger 210 in the distal direction 294 in the manner described above. However, such movement of the plunger 210 is prevented by the roller 202 and the lock control member 220. As the plunger 210 attempts to move in the distal direction 294, the plunger ramp 215 comes into contact with the roller 202 and urges the roller 202 into contact with the blocking surface 227, while the ledge 228 prevents the roller 202 from sliding along the side surface of the control member 220. As a result, interference between the roller 202 and the lock control member 220 prevents movement of the plunger 210 in the distal direction 294, thereby preventing movement of the second member 120 in the opening direction 192.

With additional reference to FIG. 2, the lock control member 220 also has an unlocking position, in which the control member ramp 225 is generally aligned with the roller 202. With the lock control member 220 in the unlocking position, the locking mechanism 200 is in an unlocked state in which distal or retracting movement of the plunger 210 is permitted. In this state, an attempt to move the second member 120 in the opening direction 192 urges the plunger 210 in the distal direction 294 in the manner described above. Such movement of the plunger 210 causes the plunger ramp 215 to urge the roller 202 into the control member pocket 224, thereby permitting continued movement of the second member 120 in the opening direction 192.

Figure 3:
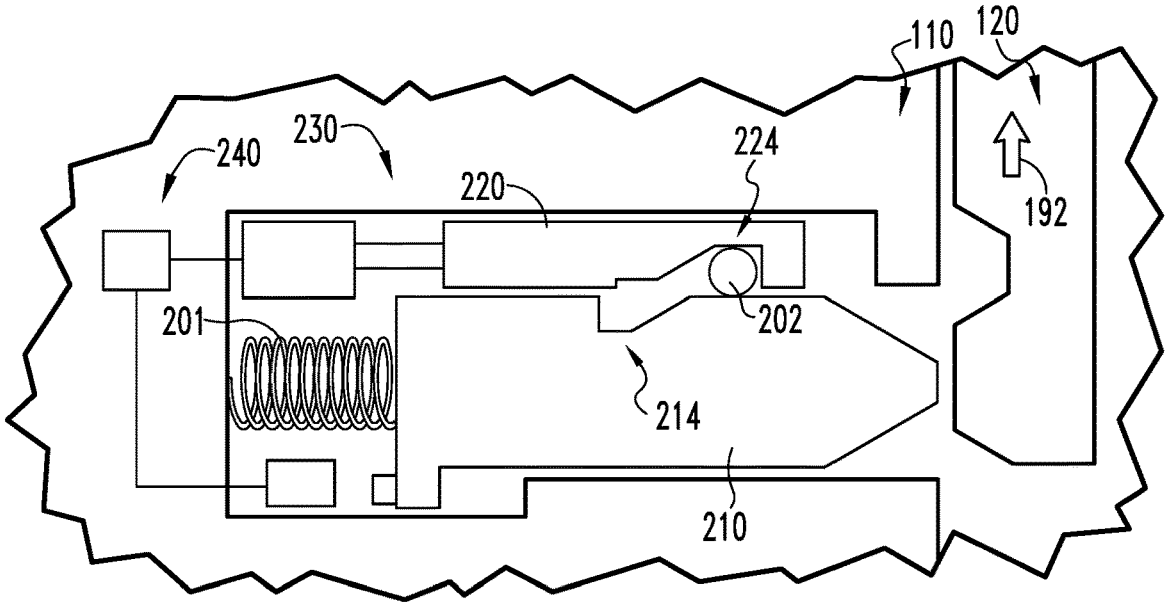
FIG. 3 is a schematic sectional view of the security assembly illustrated in FIG. 1 with the locking mechanism in the unlocked state and with the plunger in a retracted position.
Figure 4:
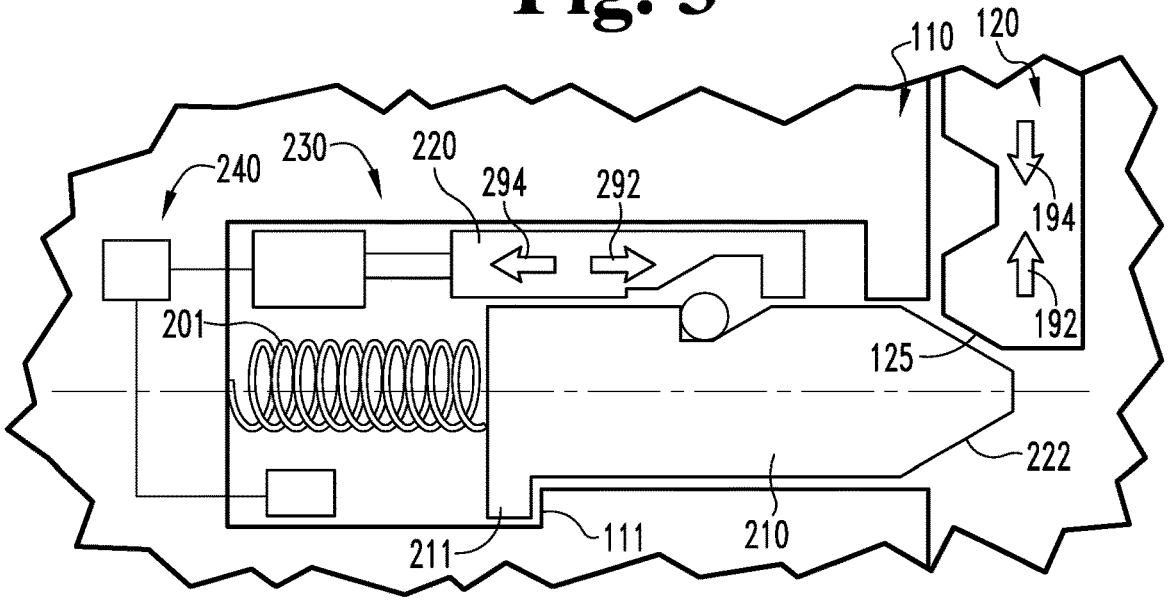
FIG. 4 is a schematic sectional view of the security assembly illustrated in FIG. 1 with the locking mechanism in the unlocked state and with the plunger in an over-extended position.

With additional reference to FIG. 3, movement of the second member 120 in the opening direction 192 initially drives the plunger 210 to the retracted position against the proximal biasing force of the spring 201. In this state, the roller 202 is at least partially seated in the control member pocket 224, and in the illustrated form is completely seated in the control member pocket 224.

With additional reference to FIG. 4, continued movement of the second member 120 in the opening direction 192 causes the end portion of the second member 120 to clear the plunger nose 212. When this occurs, the biasing force of the spring 201 urges the plunger 210 to an over-extended position that is proximal of the extended position. From this state, the second member 120 is free to continue moving in the opening direction 192. As described herein, the second member 120 can alternatively be driven in the closing direction 194 to initiate a relocking operation. Such closing movement of the second member 120 causes a cam surface 125 on the end of the second member 120 to engage the tapered nose 212, thereby urging the plunger 210 in the distal retracting direction 294 in a manner analogous to that described above. When the recess 122 once again becomes aligned with the nose 212, the plunger 210 returns to its extended position under the biasing force of the spring 201, and the relock operation may initiate.

The driver 230 is drivingly connected to the lock control member 220, and is operable to move the lock control member 220 between the locking position and the unlocking position. As described herein, the driver 230 is in communication with the control assembly 240, and is configured to move the lock control member 220 between the locking position and the unlocking position based upon signals received from the control assembly 240. In the illustrated form, the driver 230 is provided in the form of a linear actuator that is configured to linearly drive the lock control member 220 in the proximal direction 292 for locking and to drive the control member 220 in the distal direction 294 for unlocking. In other embodiments, the driver 230 may be configured to rotate a lock control member between locking and unlocking positions, for example as described with reference to FIGS. 6 and 7.

The driver 230 includes an electromechanical actuator 232 and a drive rod 234, and the actuator 232 is configured to move the drive rod 234 in the proximal and distal directions 292, 294. In the illustrated form, the actuator 232 is provided in the form of a rotary motor such as a stepping motor, and the drive rod 234 includes a screw thread that is engaged with an internally-threaded rotor of the motor 232 such that the drive rod 234 moves linearly in response to rotation of the rotor. In other embodiments, the actuator 232 may be provided in the form of a solenoid core, and the drive rod 234 may be provided as a solenoid plunger that moves in the proximal and distal directions 292, 294 in response to energization and de-energization of the solenoid core. In other words, while the illustrated driver 230 is provided as a motor-driven linear actuator, it is also contemplated that the driver 230 may be provided in the form of a solenoid.

Figure 5:
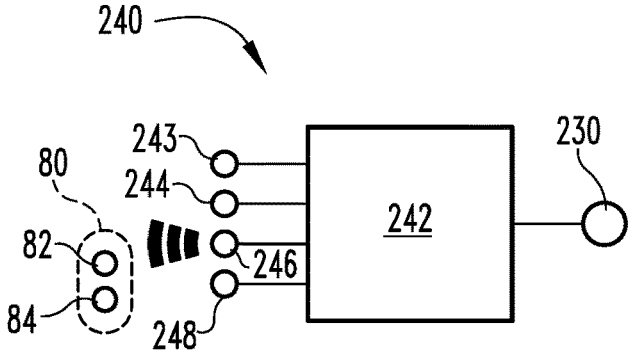
FIG. 5 is a schematic block diagram of a control assembly according to certain embodiments.

With additional reference to FIG. 5, the control assembly 240 generally includes a controller 242 in communication with the driver 230 and an onboard power supply 243 such as a battery, and further includes one or more of a credential reader 244, a wireless communication device 246, and/or a plunger position sensor 248. As described herein, the control assembly 240 is configured to transmit signals to the driver 230 to cause the driver 230 to move the lock control member 220 between its locking and unlocking positions.

The credential reader 244 is configured to read a user credential, and to determine whether the user credential is an authorized credential. In certain forms, the user credential may be embodied on a card or chip, such as a magnetic card, radio frequency identification (RFID) circuitry, or a near field communication (NFC) card, and the credential reader 244 may be configured to read such user credentials. Additionally or alternatively, the user credential may be stored on a mobile device configured to transmit the user credential to the credential reader 244. In certain embodiments, the credential reader 244 may be a biometric credential reader such as a fingerprint scanner or an iris recognition device, and the user credential may be a corresponding biometric credential. In other forms, the credential reader 244 may comprise a keypad and the user may input a user credential in the form of a personal identification number or a password using the keypad. While certain examples have been given for the credential reader 244 and the credential, it is to be appreciated that such examples are illustrative only and are non-limiting in nature.

The wireless communication device 246 is configured to facilitate communication between the controller 242 and one or more external devices 80, such as an access control system 82 and/or a mobile device 84. The wireless communication device 246 may cooperate with the credential reader 244 to send and receive credential information. As one example, the wireless communication device 246 may include a Bluetooth Low Energy (BLE) chip that communicates with the access control system 82 and/or the mobile device 84, and the control system 240 may issue one or more commands based upon information received from the access control system 82 and/or the mobile device 84.

The plunger position sensor 248 is associated with the plunger 210 such that the plunger position sensor 248 is operable to distinguish between at least two positions of the plunger 210. More particularly, the plunger position sensor 248 is operable to distinguish between at least two positions selected from the group including the extended position (FIG. 2), the retracted position (FIG. 3), and the over-extended position (FIG. 4). By way of example, the sensor 248 may be provided in the form of a switch that has a first state in response to the over-extended position and a second state in response to the extended position. As another example, the sensor 248 may be provided in the form of a Hall effect sensor, and a magnet 249 may be mounted to the distal end of the plunger 210 such that the sensor 248 is operable to distinguish between the extended position, the retracted position, and the over-extended position.

As noted above, the control assembly 240 is in communication with the driver 230, and is configured to transmit signals to the driver 230 to cause the driver 230 to move the lock control member 220 between its locking and unlocking positions. The controller 242 is configured to determine an unlock condition based upon information received from the credential reader 244 and/or the wireless communication device 246, and to transmit an unlock signal to the driver 230 in response to determining the unlock condition. The controller 242 is also configured to determine a relock condition based upon one or more criteria, and to transmit a lock signal to the driver 230 in response to determining the relock condition. As will be appreciated, the driver 230 is configured to move the lock control member 220 from the locking position to the unlocking position in response to the unlock signal, and to move the lock control member 220 from the unlocking position to the locking position in response to the lock signal.

In the illustrated form, the controller 242 is configured to determine the relock condition based upon information received from the plunger position sensor 248. More particularly, the controller 242 is configured to determine the relock condition in response to the sensor 248 transitioning from a state that indicates that the second member 120 is in the open position (FIG. 4) to a state that indicates that the second member 120 is in the fully closed position (FIG. 2). The fully closed position of the second member 120 is correlated with the extended position of the plunger 210 (FIG. 2), the partially closed position of the second member 120 is correlated with the retracted position of the plunger 210 (FIG. 3), and the open position of the second member 120 is correlated with the over-extended position of the plunger 210 (FIG. 4). As noted above, the plunger position sensor 248 is configured to distinguish between at least two of these positions for the plunger 210. Thus, the controller 242 is capable of determining the position of the second member 120 based upon information received from the plunger position sensor 248.

In certain forms, the plunger position sensor 248 is configured to distinguish between at least the extended position and the retracted position. In such forms, the controller 242 may determine the relock condition in response to the information from the sensor 248 indicating that the plunger 210 has moved from the retracted position to the extended position. Such movement is indicative of the second member 120 moving from the partially closed position to the fully closed position.

In certain forms, the plunger position sensor is configured to distinguish between at least the extended position and the over-extended position. In such forms, the controller 242 may determine the relock condition in response to the information from the sensor 248 indicating that the plunger 210 has moved from the over-extended position to the extended position. Such movement is indicative of the second member 120 moving from the open position to the fully closed position.

In certain forms, the plunger position sensor is configured to distinguish between all three of the extended position, the over-extended position, and the retracted position. In such forms, the controller 242 may determine the relock condition in response to the information from the sensor 248 indicating that the plunger 210 has moved from the over-extended position to the extended position by way of the retracted position. Such movement is indicative of the second member 120 moving from the open position to the fully closed position by way of the partially closed position.

As should be evident from the foregoing, the use of the plunger position sensor 248 enables the controller 242 to determine the relock condition when the second member 120 has returned to its fully closed position. This eliminates the need for the user to manually return the locking member to its locking position and/or the need for lost-motion energy storage, each of which has been relied upon in certain conventional padlocks to ensure that a locking member returns to its locking position once the shackle has been closed.

Figure 6:
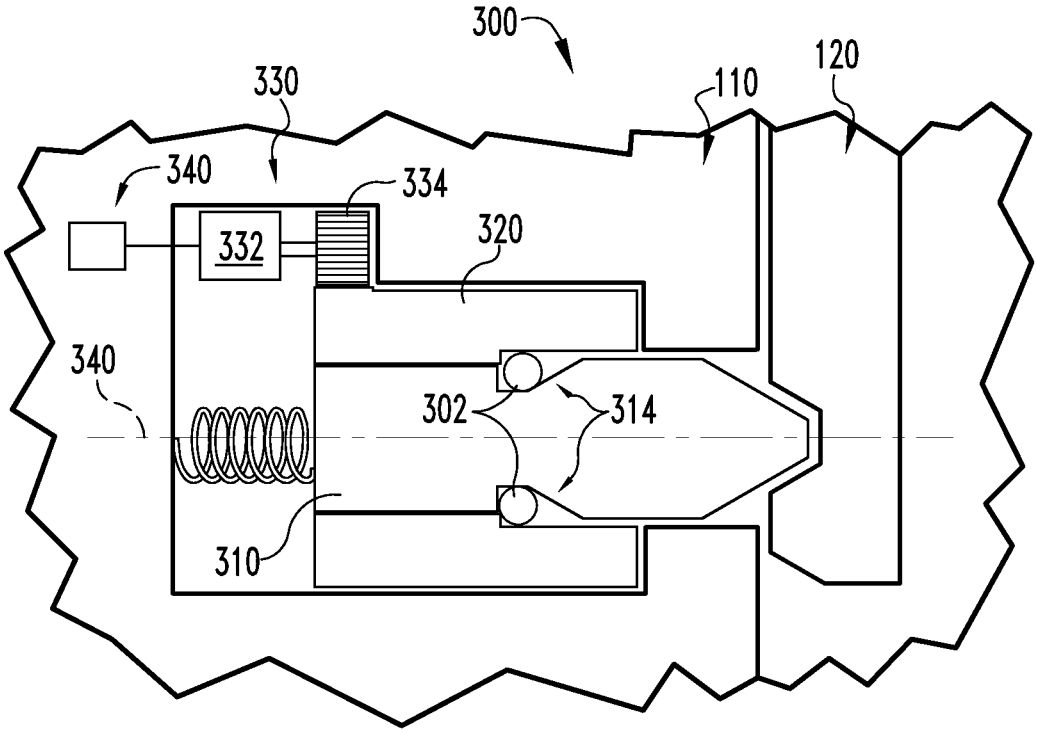
FIG. 6 is a schematic sectional view of a security assembly including a locking mechanism according to certain embodiments in a locked state.
Figure 7:
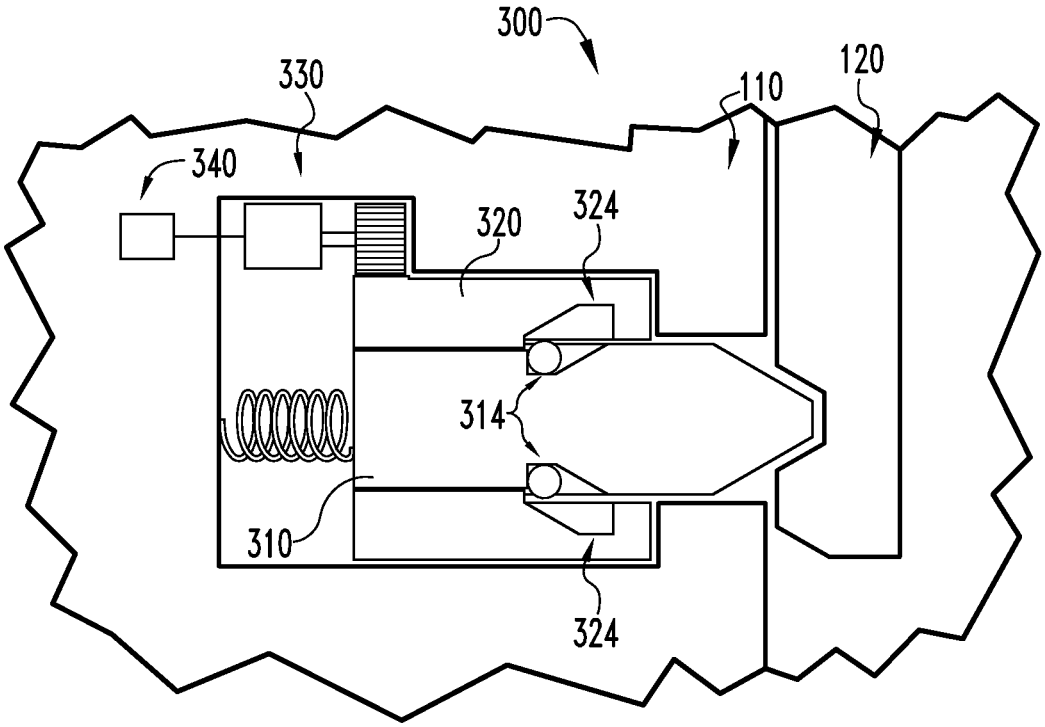
FIG. 7 is a schematic sectional view of the security assembly illustrated in FIG. 6 with the locking mechanism in an unlocked state.

With reference to FIGS. 6 and 7, illustrated therein is a locking mechanism 300 according to certain embodiments. The locking mechanism 300 is substantially similar to the above-described locking mechanism 200, and unless indicated otherwise, similar reference characters are used to indicate similar elements and features. For example, the locking mechanism 300 includes a plunger 310, a lock control member 320, a driver 330, and a control assembly 340, which respectively correspond to the plunger 210, the lock control member 220, the driver 230, and the control assembly 240. In the interest of conciseness, the following descriptions of the locking mechanism 300 focus primarily on features that are different from those described above with regard to the locking mechanism 200.

In the illustrated embodiment, the plunger 310 has a cylindrical body portion, and the lock control member 320 is provided as a sleeve that circumferentially surrounds at least a portion of the plunger 310. Additionally, the locking mechanism 300 includes a plurality of rollers 302, and each of the plunger 310 and the lock control member 320 includes a corresponding plurality of pockets 314, 324. In contrast to the above-described lock control member 220, the lock control member 320 is mounted for rotation about the longitudinal axis 390. Accordingly, the driver 330 is configured to rotate the lock control member 320 between its locking position (FIG. 6) and its unlocking position (FIG. 7). More particularly, the actuator 332 is provided as a rotary motor that rotates a gear 334, the teeth of which are meshed with teeth formed on at least a portion of the outer periphery of the lock control member 320. Thus, the driver 330 is operable to rotate the lock control member 320 between its locking and unlocking positions.

With reference to FIG. 8, illustrated therein is an embodiment of a security assembly in the form of a padlock 400. The padlock 400 includes a body portion 410 and a shackle 420, which respectively correspond to the first member 110 and the second member 120 of the security assembly 100. The padlock 400 also includes the locking mechanism 200, which functions in the manner described above to selectively retain the shackle 420 in a closed position relative to the body portion 410.

With reference to FIG. 9, illustrated therein is an embodiment of a security assembly in the form of a cabinet 500. The cabinet 500 includes a body portion 510 and a drawer 520, which respectively correspond to the first member 110 and the second member 120 of the security assembly 100. The cabinet 500 also includes the locking mechanism 200, which functions in the manner described above to selectively retain the drawer 520 in a closed position relative to the body portion 510. While the illustrated embodiment has the locking mechanism 200 mounted to the body portion 510 of the cabinet 500, it is also contemplated that the locking mechanism 200 may instead be mounted to the drawer 520. For example, the face of the drawer 520 may have a keypad mounted thereon, and the keypad may serve as the credential reader of the locking mechanism 200.

Figure 10:
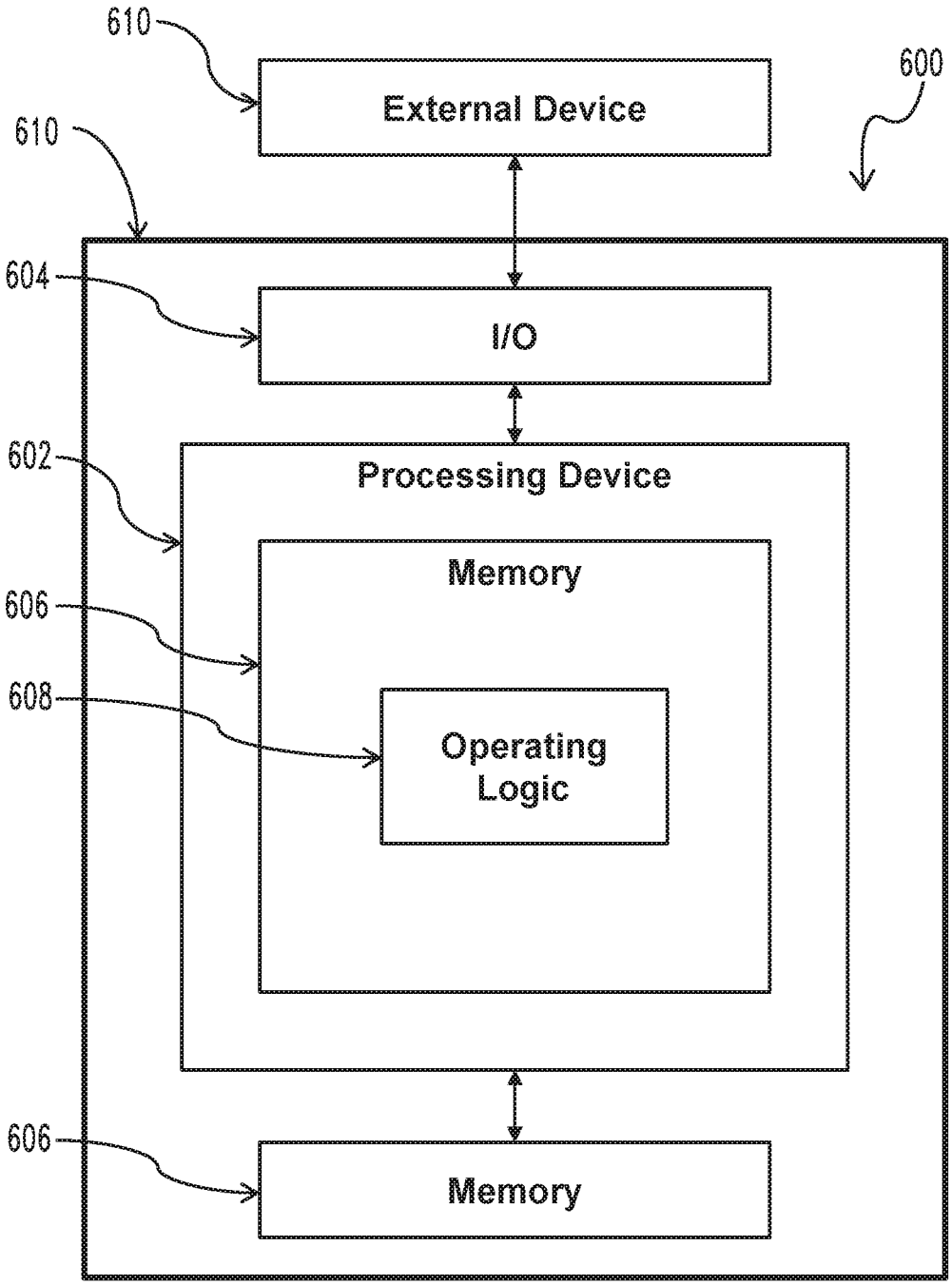
FIG. 10 is a schematic block diagram of a computing device that may be utilized in connection with certain embodiments.

FIG. 10 is a schematic block diagram of a computing device 600. The computing device 600 is one example of a computer, server, mobile device, reader device, or equipment configuration which may be utilized in connection with the control assembly 240 shown in FIG. 1. The computing device 600 includes a processing device 602, an input/output device 604, memory 606, and operating logic 608. Furthermore, the computing device 600 communicates with one or more external devices 610.

The input/output device 604 allows the computing device 600 to communicate with the external device 610. For example, the input/output device 604 may be a network adapter, network card, interface, or a port (e.g., a USB port, serial port, parallel port, an analog port, a digital port, VGA, DVI, HDMI, FireWire, CAT 5, or any other type of port or interface). The input/output device 604 may be comprised of hardware, software, and/or firmware. It is contemplated that the input/output device 604 includes more than one of these adapters, cards, or ports.

The external device 610 may be any type of device that allows data to be inputted or outputted from the computing device 600. For example, the external device 610 may be a mobile device, a reader device, equipment, a handheld computer, a diagnostic tool, a controller, a computer, a server, a printer, a display, an alarm, an illuminated indicator such as a status indicator, a keyboard, a mouse, or a touch screen display. Furthermore, it is contemplated that the external device 610 may be integrated into the computing device 600. It is further contemplated that there may be more than one external device in communication with the computing device 600.

The processing device 602 can be of a programmable type, a dedicated, hardwired state machine, or a combination of these; and can further include multiple processors, Arithmetic-Logic Units (ALUs), Central Processing Units (CPUs), Digital Signal Processors (DSPs) or the like. For forms of processing device 602 with multiple processing units, distributed, pipelined, and/or parallel processing can be utilized as appropriate. The processing device 602 may be dedicated to performance of just the operations described herein or may be utilized in one or more additional applications. In the depicted form, the processing device 602 is of a programmable variety that executes algorithms and processes data in accordance with operating logic 608 as defined by programming instructions (such as software or firmware) stored in memory 606. Alternatively or additionally, the operating logic 608 for processing device 602 is at least partially defined by hardwired logic or other hardware. The processing device 602 can be comprised of one or more components of any type suitable to process the signals received from input/output device 604 or elsewhere, and provide desired output signals. Such components may include digital circuitry, analog circuitry, or a combination of both.

The memory 606 may be of one or more types, such as a solid-state variety, electromagnetic variety, optical variety, or a combination of these forms. Furthermore, the memory 606 can be volatile, nonvolatile, or a combination of these types, and some or all of memory 606 can be of a portable variety, such as a disk, tape, memory stick, cartridge, or the like. In addition, the memory 606 can store data that is manipulated by the operating logic 608 of the processing device 602, such as data representative of signals received from and/or sent to the input/output device 604 in addition to or in lieu of storing programming instructions defining the operating logic 608, just to name one example. As shown in FIG. 6, the memory 606 may be included with the processing device 602 and/or coupled to the processing device 602.

The processes in the present application may be implemented in the operating logic 608 as operations by software, hardware, artificial intelligence, fuzzy logic, or any combination thereof, or at least partially performed by a user or operator. In certain embodiments, units represent software elements as a computer program encoded on a non-transitory computer readable medium, wherein control assembly 240 performs the described operations when executing the computer program.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected.

It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A security assembly, comprising:

a first member;

a second member mounted for linear movement relative to the first member between an open position and a closed position, wherein the second member is linearly movable along a movement axis defining an opening direction and an opposite closing direction, and wherein the second member includes a recess having a first cam surface; and a locking mechanism mounted to the first member, the locking mechanism comprising:

a plunger including a tapered nose and a first pocket, the plunger having an extended position and a retracted position, wherein the plunger is mounted for movement along a longitudinal axis defining a proximal extending direction and a distal retracting direction, and wherein the plunger is biased in the proximal extending direction;

a lock control member including a second pocket and a blocking surface, the lock control member having an unlocking position in which the second pocket is aligned with the first pocket, the lock control member having a locking position in which the blocking surface is aligned with the first pocket;

a roller captured between the plunger and the lock control member, wherein the roller is operable to be at least partially received in the first pocket and is operable to be at least partially received in the second pocket; and a driver operably connected with the lock control member, wherein the driver is configured to move the lock control member from the locking position to the unlocking position in response to an unlock signal;

wherein the locking mechanism has a locking state in which the lock control member is in the locking position, the tapered nose of the plunger is received in the recess such that movement of the second member in the opening direction urges the plunger to move in the distal retracting direction, and interference between the roller and the blocking surface prevents movement of the plunger in the distal retracting direction, thereby preventing movement of the second member in the opening direction; and wherein the locking mechanism has an unlocking state in which the lock control member is in the unlocking position such that the roller is operable to move into the second pocket, thereby enabling movement of the plunger in the distal retracting direction.

2. The security assembly of claim 1, wherein the lock control member is mounted for sliding movement between the locking position and the unlocking position, and wherein the driver comprises a linear actuator.

3. The security assembly of claim 1, wherein the lock control member is mounted for rotational movement between the locking position and the unlocking position, and wherein the driver comprises a rotary motor.

4. The security assembly of claim 1, wherein the movement axis is perpendicular to the longitudinal axis.

5. The security assembly of claim 1, wherein the security assembly comprises a padlock, wherein the first member is a body portion of the padlock, and wherein the second member is a shackle of the padlock.

6. The security assembly of claim 1, wherein the security assembly comprises a cabinet, wherein the first member is a body portion of the cabinet, and wherein the second member is a drawer slidably mounted to the body portion.

7. The security assembly of claim 1, wherein the lock mechanism further comprises a control assembly in communication with the driver; and wherein the control assembly includes a controller configured to determine an unlock condition based upon one or more criteria and to transmit the unlock signal to the driver in response to the unlock condition.

8. The security assembly of claim 7, wherein the control assembly further comprises a credential reader in communication with the controller, and wherein the controller is configured to determine the unlock condition based upon information received from the credential reader.

9. The security assembly of claim 7, wherein the control assembly further comprises a wireless communication device in communication with the controller, and wherein the controller is configured to determine the unlock condition based upon information received from the wireless communication device.

10. The security assembly of claim 7, wherein the locking mechanism further comprises an onboard power supply, and wherein the controller and the driver are configured to receive electrical power from the onboard power supply.

11. The security assembly of claim 7, wherein the controller is further configured to determine a relock condition subsequent to transmitting the unlock signal and to transmit a relock signal in response to determining the relock condition, and wherein the driver is configured to move the lock control member from the unlocking position to the locking position in response to the relock signal.

12. The security assembly of claim 11, wherein the control assembly further comprises a plunger position sensor in communication with the controller, and wherein the controller is configured to determine the relock condition based upon information received from the plunger position sensor.

13. The security assembly of claim 12, wherein the controller is configured to determine the relock condition in response to the plunger position sensor transitioning from a first state indicative of a first position of the plunger to a second state indicative of a second position of the plunger.

14. A locking mechanism configured for use with a security assembly including a first member and a second member having an open position and a closed position relative to the first member, wherein the locking mechanism is configured to be mounted to the first member and comprises:

a plunger including a first pocket, the plunger having an extended position and a retracted position, wherein the plunger is mounted for movement along a longitudinal axis defining a proximal extending direction and a distal retracting direction, and wherein the plunger is biased in the proximal extending direction;

a lock control member including a second pocket and a blocking surface, the lock control member having an unlocking position in which the second pocket is aligned with the first pocket, the lock control member having a locking position in which the blocking surface is aligned with the first pocket;

a roller captured between the plunger and the lock control member, wherein the roller is operable to be at least partially received in the first pocket and is operable to be at least partially received in the second pocket;

a driver operably connected with the lock control member; and a control assembly in communication with the driver, wherein the control assembly comprises:

a controller in communication with the driver, wherein the controller is operable to transmit an unlock signal that causes the driver to move the lock control member from the locking position to the unlocking position, and wherein the controller is operable to transmit a relock signal that causes the driver to move the lock control member from the unlocking position to the locking position;

an input device in communication with the controller, wherein the controller is configured to transmit the unlock signal based upon information received from the input device; and a plunger position sensor operable to distinguish between at least two positions of the plunger, wherein the controller is configured to transmit the relock signal based upon information received from the plunger position sensor;

wherein the locking mechanism has a locking state in which the lock control member is in the locking position, and interference between the roller and the blocking surface prevents movement of the plunger in the distal retracting direction; and wherein the locking mechanism has an unlocking state in which the lock control member is in the unlocking position such that the roller is operable to move into the second pocket, thereby enabling movement of the plunger in the distal retracting direction.

15. The locking mechanism of claim 14, wherein the plunger has a tapered nose operable to interface with the second member such that when the locking mechanism is in the unlocking state, the plunger is urged between the extended position and the retracted position as the second member moves between the closed position and the open position.

16. The locking mechanism of claim 14, wherein the plunger position sensor is operable to distinguish between a first position of the plunger and a second position of the plunger, and wherein the controller is configured to transmit the relock signal in response to the plunger moving from the first position to the second position.

17. The locking mechanism of claim 16, wherein the plunger has a tapered nose configured to interface with the second member such that when the locking mechanism is in the unlocking state, the plunger moves from the first position to the second position as the second member moves from the open position to the closed position.

18. The locking mechanism of claim 15, wherein the closed position is a fully closed position, wherein the second member has a partially closed position between the fully closed position and the open position, and wherein the at least two positions are selected from the group consisting of:

(i) the retracted position, wherein the retracted position is correlated with the partially closed position of the second member, (ii) the extended position, wherein the extended position is correlated with the fully closed position of the second member, and (iii) an over-extended position proximal of the extended position, wherein the over-extended position is correlated with the open position of the second member.

19. The locking mechanism of claim 14, wherein the lock control member further comprises a ledge adjacent the blocking surface, wherein the ledge prevents the roller from traveling along a side surface of the lock control member as the plunger moves in the distal retracting direction.

20. The locking mechanism of claim 14, further comprising an onboard power supply operable to supply electrical power to the controller and the driver.

21. The locking mechanism of claim 14, wherein the input device comprises a credential reader.

22. A security assembly, comprising:

a first member;

a second member mounted for linear movement relative to the first member between an open position and a closed position, wherein the second member includes a recess; and a lock mechanism mounted to the first member, the lock mechanism comprising:

a plunger including a first pocket, wherein the plunger is biased toward an extended position and is movable toward a retracted position;

a roller seated at least partially in the first pocket;

a lock control member including a second pocket and a blocking surface, the lock control member having an unlocking position in which the roller is operable to move into the second pocket and retraction of the plunger is enabled, the lock control member having a locking position in which the blocking surface is aligned with the first pocket such that the lock control member and the roller prevent retraction of the plunger; and a driver operably connected with the lock control member, wherein the driver is configured to move the lock control member from the locking position to the unlocking position in response to an unlock signal;

wherein the lock mechanism has a locking state in which the plunger is in the extended position and is engaged with the recess, and the lock control member is in the locking position such that the lock control member and the roller and prevent retraction of the plunger; and wherein the lock mechanism has an unlocking state in which the lock control member is in the unlocking position, thereby enabling retraction of the plunger.

23. The security assembly of claim 22, further comprising a control assembly in communication with the driver; and wherein the control assembly is configured to determine an unlock condition based upon one or more criteria and to transmit an unlock signal in response to the unlock condition.

* * * * *